US007416418B2

(12) United States Patent
Berthet et al.

(10) Patent No.: US 7,416,418 B2
(45) Date of Patent: Aug. 26, 2008

(54) COAXIAL CONNECTOR FOR INTERCONNECTING TWO PRINTED CIRCUIT CARDS

(75) Inventors: Vincent Berthet, St Joseph de Riviere (FR); Bernard Constantin, Le Pin (FR)

(73) Assignee: Radiall, Rosny-Sous-Bois (FR)

( * ) Notice: Subject to any disclaimer, the term of this patent is extended or adjusted under 35 U.S.C. 154(b) by 0 days.

(21) Appl. No.: 11/882,527

(22) Filed: Aug. 2, 2007

(65) Prior Publication Data

US 2008/0057782 A1 Mar. 6, 2008

(30) Foreign Application Priority Data

Aug. 31, 2006 (FR) ..... 06 53539

(51) Int. Cl.
*H01R 12/00* (2006.01)

(52) U.S. Cl. ..... 439/66; 439/63

(58) Field of Classification Search ..... 439/66, 439/63

See application file for complete search history.

(56) References Cited

U.S. PATENT DOCUMENTS

| | | | | | |
|---|---|---|---|---|---|
| 4,603,926 | A * | 8/1986 | Nesbit et al. | 439/63 |
| 4,925,403 | A * | 5/1990 | Zorzy | 439/578 |
| 5,329,262 | A * | 7/1994 | Fisher, Jr. | 333/33 |
| 5,380,211 | A * | 1/1995 | Kawaguchi et al. | 439/74 |
| 5,516,303 | A * | 5/1996 | Yohn et al. | 439/248 |
| 5,791,911 | A * | 8/1998 | Fasano et al. | 439/63 |
| 5,928,000 | A * | 7/1999 | Rudisill et al. | 439/63 |
| 5,980,290 | A * | 11/1999 | Meynier et al. | 439/246 |
| 6,079,986 | A * | 6/2000 | Beshears | 439/63 |
| 6,350,155 | B1 * | 2/2002 | Mullinger-Bausch et al. | 439/675 |
| 6,409,550 | B1 | 6/2002 | Splichal et al. | |
| 6,497,579 | B1 * | 12/2002 | Garbini | 439/63 |
| 6,506,069 | B2 * | 1/2003 | Babala et al. | 439/248 |
| 6,558,177 | B2 * | 5/2003 | Havener et al. | 439/246 |
| 6,590,478 | B2 * | 7/2003 | Pluymers | 333/246 |
| 6,699,054 | B1 * | 3/2004 | Critelli | 439/248 |
| 6,758,680 | B2 * | 7/2004 | Duquerroy et al. | 439/63 |
| 6,776,668 | B1 * | 8/2004 | Scyoc et al. | 439/700 |
| 6,827,608 | B2 * | 12/2004 | Hall et al. | 439/578 |
| 7,118,383 | B2 * | 10/2006 | Nagata et al. | 439/63 |
| 7,210,941 | B2 * | 5/2007 | Rosenberger | 439/63 |
| 2004/0038586 | A1 * | 2/2004 | Hall et al. | 439/578 |
| 2004/0102061 | A1 * | 5/2004 | Watanabe | 439/63 |
| 2007/0026698 | A1 * | 2/2007 | Rosenberger | 439/63 |

* cited by examiner

*Primary Examiner*—Ross N Gushi
(74) *Attorney, Agent, or Firm*—Oliff & Berridge, PLC

(57) ABSTRACT

A coaxial connector for interconnecting two printed circuit cards, the connector comprising a cylindrical first connector element designed to be secured at one end to a first printed circuit card, and a second cylindrical connector element designed to come into contact via one end with a second printed circuit card, each connector element having a central contact and an outer contact separated by insulation, resilient means being interposed between the first and second connector elements and urging the central and outer contacts of the second connector element towards the second printed circuit card. The connector has annular bearing surfaces offset radially outwards from the central contact bodies and co-operating therewith to define a first volume in which a first spring is mounted, and annular bearing surfaces offset radially inwards from the outer contact bodies and co-operating therewith to define a second volume in which a second spring is mounted.

6 Claims, 2 Drawing Sheets

COAXIAL CONNECTOR FOR INTERCONNECTING TWO PRINTED CIRCUIT CARDS

The present invention relates to a coaxial connector for interconnecting two printed circuit cards, of the type for interconnecting very high frequency transmission lines situated on two parallel printed circuit cards.

BACKGROUND

Coaxial connectors are already known for interconnecting two printed circuit cards, such a connector comprising a cylindrical first connector element designed to be secured at one end to a first printed circuit card, and a second cylindrical connector element designed to come into contact via one end with a second printed circuit card, each connector element having a central contact and an outer contact separated by insulation, the central and outer contacts of the first and second connector elements having mutually-contacting cylindrical bearing surfaces, resilient means being interposed between the first and second connector elements and urging the central and outer contacts of the second connector element towards the second printed circuit card.

The first connector element is secured, in particular by soldering, to the first printed circuit card, and the second card is caused to press against the second connector element, which is thus moved relative to the first connector element, the contacts of the second connector element being pressed under the action of the resilient means against conductive zones provided on the first card.

A connector of that type in which the resilient means are elastomer O-rings is described in U.S. Pat. No. 6,699,054, and a connector of that type in which the resilient means are compression springs is described in U.S. Pat. No. 6,776,668.

Presently-known coaxial connectors are of a structure that means they present large variations in impedance along their length. In particular, in the connector described in U.S. Pat. No. 6,776,668, there is a high impedance zone at the central contact of the second connector element.

In addition, known connectors do not accommodate a large stroke in the relative movement between the connector elements, which means that the cards must be spaced apart with great accuracy.

SUMMARY

The present invention proposes making a coaxial connector for interconnecting two printed circuit cards while avoiding in particular the above-mentioned drawbacks and while enabling two printed circuit cards to be connected together without requiring a high degree of accuracy in alignment, without generating large insertion forces, and without requiring accurate systems for maintaining distance between the cards.

In addition, the coaxial connector of the invention lends itself to printed circuit cards with very high integration density thereon, thus enabling a very large number of very high frequency transmission lines to be interconnected simultaneously, in particular lines operating at frequencies up to 18 gigahertz (GHz) situated on two parallel printed circuit cards.

The coaxial connector of the present invention can be used in particular in latest generation radars that make use of electronically-scanned antennas that are made up of a large number of radiation sources.

The coaxial connector of the present invention is essentially in that the mutually-contacting cylindrical bearing surfaces of the central contacts of the first and second connector elements are annular bearing surfaces offset radially outwards from the central contact bodies and co-operating therewith to define a first volume in which a first spring is mounted, and that the mutually-contacting cylindrical bearing surfaces of the outer contacts of the first and second connector elements are annular bearing surfaces offset radially inwards from the outer contact bodies and co-operate therewith to define a second volume in which a second spring is mounted.

Preferably, the contact zone between the annular bearing surfaces of the central contact is closer to the end whereby the first connector element is designed to the secured to the first printed circuit card than to the contact zone between the annular bearing surfaces of the outer contacts.

Advantageously, the springs are helical compression springs.

Preferably, the diameter of the annular bearing surface of the central contact of the first connector element is smaller than the diameter of the annular bearing surface of the central contact of the second connector element, and the diameter of the annular bearing surface of the outer contact of the first connector element is less than the diameter of the outer bearing surface of the outer contact of the second connector element.

Furthermore, in order to prevent electromagnetic leakage, an electromagnetic shielding ring is disposed in the second volume around the inwardly-offset bearing surface of the outer contact of the second connector element.

BRIEF DESCRIPTION OF THE DRAWINGS

In order to make the invention better understood, there follows a description by way of non-limiting example of an embodiment given with reference to the accompanying drawings, in which.

MORE DETAILED DESCRIPTION

Figure 1:
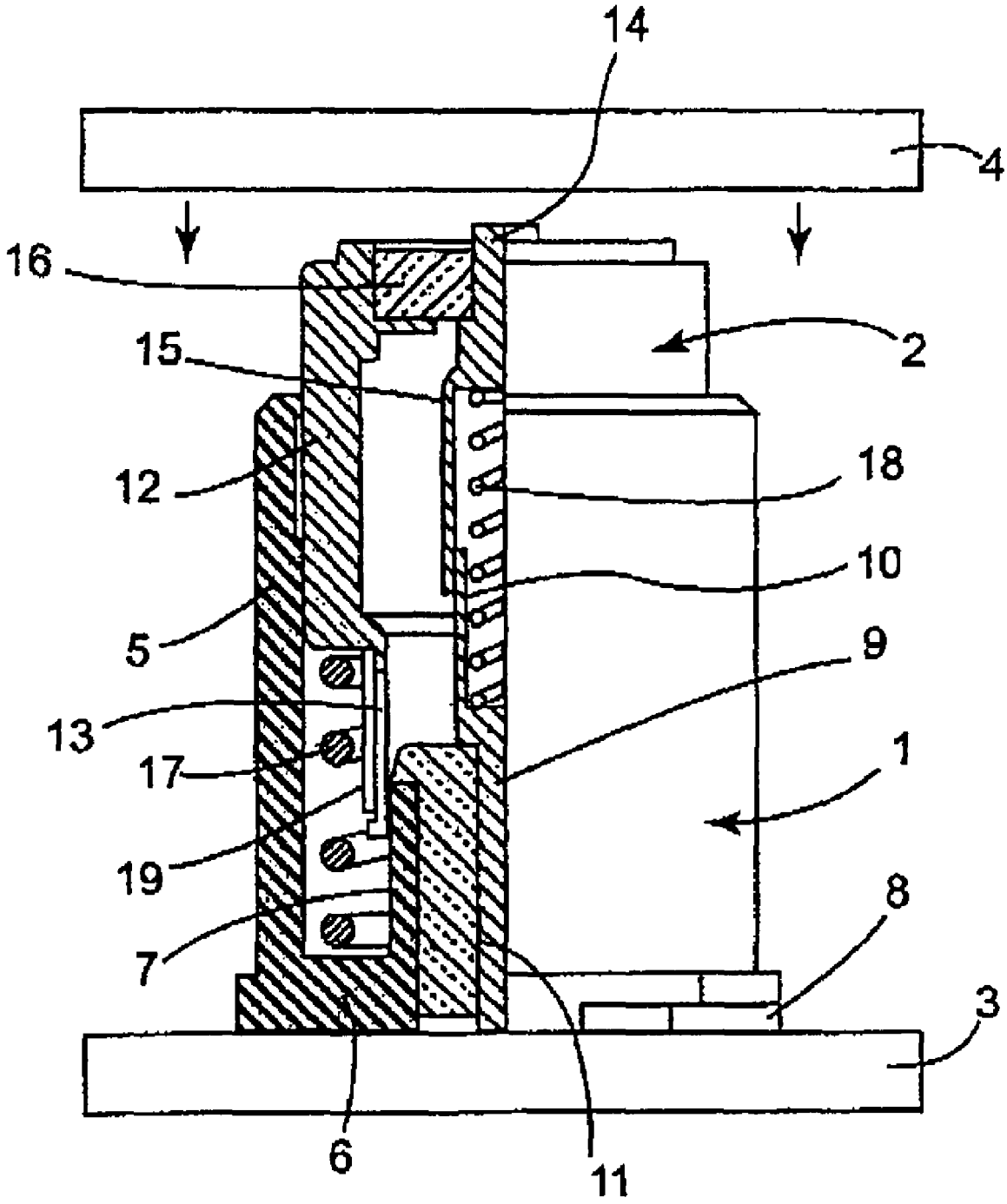
FIG. 1 is an elevation view in half-section of a coaxial connector of the invention.

FIG. 1 shows a coaxial connector of the invention comprising a first connector element given overall reference 1 and a second connector element given overall reference 2.

The connector element 2 can slide in limited manner inside the connector element 1.

The connector element 1 shown is secured on a printed circuit card 3, another printed circuit card 4 being shown approaching towards the connector, as represented by arrows.

Below, the connector element 1 and its components are said to be "stationary" while the connector element 2 and its components are said to be "movable".

The stationary connector element 1 comprises a ground outer contact body 5 having an annular base portion 6 connected to an annular bearing surface 7 disposed concentrically with the body 5 and projecting towards the inside thereof.

The stationary outer contact made in this way is secured to the printed circuit card 3 by solder 8.

The stationary central contact includes a cylindrical contact body 9 presenting a step from which there extends an annular bearing surface 10, which thus overhangs the outside of the body 9. Insulation 11 is interposed between the stationary contact body 9 and the bearing surface 7 of the stationary outer contact.

The movable connector element 2 comprises a tubular outer body 12 extended by an annular bearing surface 13 that lies in contact with the bearing surface 7 of the stationary outer contact, as can be seen in the drawing. The bearing surface 13 is offset inwards relative to the body 12.

The movable central contact has a movable contact body 14 extended by an annular bearing surface 15 that is offset outwards. As can be seen in FIG. 1, this bearing surface 15 is in contact with the bearing surface 10 of the stationary central contact.

The stationary contact body 9 is secured to the printed circuit card 3 by solder, in particular in a plated-through hole in the printed circuit card. Insulation 16 is interposed between the body of the movable outer contact 12 and the body of the movable central contact 14. As can be seen in FIG. 1, before it is pressed by the card 4, the movable central contact body 14 projects a little from the end face of the movable outer contact body 12.

A helical compression spring 17 is put into place between the stationary and movable outer contacts, and a helical compression spring 18 is put into place between the stationary and movable central contacts, the helical springs 17 and 18, when compressed by the card 4 pressing thereagainst, tending to apply the movable central and outer contacts under pressure against the printed circuit card 4.

A shielding ring 19 for shielding against electromagnetic radiation is placed around the bearing surface 13.

Figure 2:
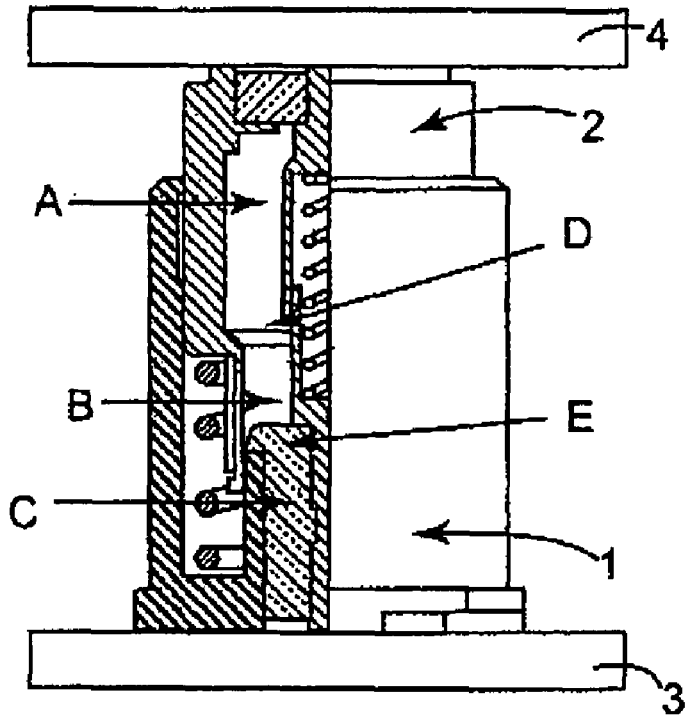
FIGS. 2 and 3 are views analogous to the view of FIG. 1 showing the connector in two extreme utilization positions.
Figure 3:
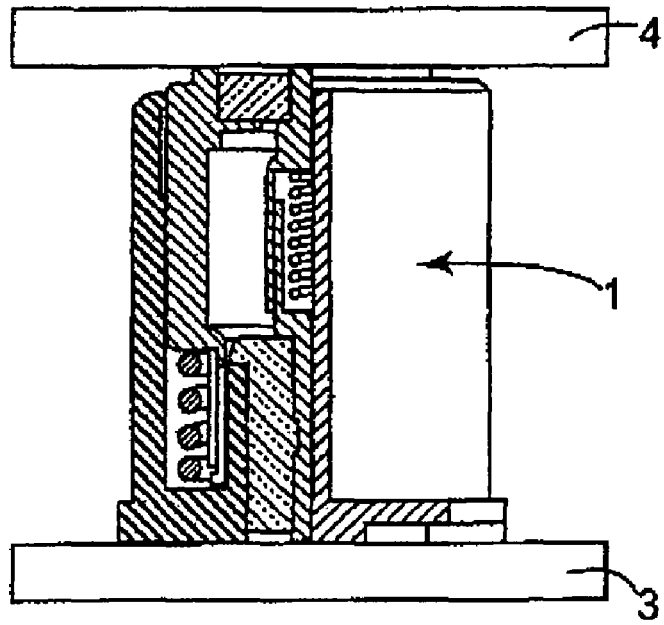

FIG. 2 shows the FIG. 1 connector in its utilization position with a maximum distance between the cards, while FIG. 3 shows the connector with a minimum distance between the cards.

When the card 4 presses against the movable connector element, the element slides in the stationary connector element and a compression force due to the springs presses the stationary and movable central contacts between determined wheels of the card, with it being possible for them to be off-center by up to 0.7 millimeters (mm).

In the example shown in the position of FIG. 2, the compression force is 4.2 newtons (N), while in the position of FIG. 3 it is 9.6 N.

It can be seen that the displacement between the minimum and maximum positions is large, with a minimum operating stroke of 1.2 mm being obtained. In the example shown, this stroke is 1.6 mm. This stroke can be further increased by modifying the length dimensions of the movable outer contact and of the movable central contact. In practice, it is possible to envisage a distance between cards of up to 20 mm.

In the invention, a reflection coefficient at 18 GHz is obtained that is small and independent of the distance between the printed circuits, by defining the inside diameters (D) of the ground bodies 7 and 12 and the outside diameters (d) of the central contacts 9 and 14 that govern the impedance of the transmission line segments marked by arrows A, B, and C in FIG. 2 using the formula:

$$\frac{138}{\sqrt{\varepsilon}} \times \mathrm{Log}\left(\frac{D}{d}\right)$$

so that they are equal and identical to the characteristic impedance $Z_0$ of the access lines, e.g. 50 ohms (Ω). The segments A and C are of unchanging lengths. The matching zones D and E are dimensional transitions between the zones A, B, and C of characteristic impedance $Z_0$ and they are likewise of unvarying lengths. Their greatest impedances and their widths are defined so as to minimize reflections throughout the working frequency band 0-18 GHz. A change in the distance between the printed circuits 3 and 4 therefore does not change the characteristics of these matching zones, with length varying solely in the segment B and this has no impact on reflection levels since it presents the characteristic impedance $Z_0$.

This ensures very good radio frequency characteristics up to 18 GHz independently of the distance between the cards. In particular, a standing wave ratio (SWR) of less than 1.5 is obtained up to a frequency of 18 GHz.

Although the invention is described above with reference to a particular embodiment of the invention, it is clear that the invention is not limited in any way thereto and variations and modifications can be applied thereto without going beyond its ambit as defined in the following claims.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A coaxial connector for interconnecting two printed circuit cards, the connector comprising a cylindrical first connector element designed to be secured at one end to a first printed circuit card, and a second cylindrical connector element designed to come into contact via one end with a second printed circuit card, each connector element having a central contact and an outer contact separated by insulation, the central and outer contacts of the first and second connector elements having mutually-contacting cylindrical bearing surfaces, and resilient means being interposed between the first and second connector elements and urging the central and outer contacts of the second connector element towards the second printed circuit card, wherein the mutually-contacting cylindrical bearing surfaces of the central contacts of the first and second connector elements are annular bearing surfaces offset radially outwards from the central contact bodies and co-operating therewith to define a first volume in which a first spring is mounted, and wherein the mutually-contacting cylindrical bearing surfaces of the outer contacts of the first and second connector elements are annular bearing surfaces offset radially inwards from the outer contact bodies and co-operate therewith to define a second volume in which a second spring is mounted.

2. A coaxial connector according to claim 1, wherein the contact zone between the annular bearing surfaces of the central contact is closer to the end whereby said first connector element is designed to the secured to the first printed circuit card than to the contact zone between the annular bearing surfaces of the outer contacts.

3. A coaxial connector according to claim 1, wherein said springs are helical compression springs.

4. A coaxial connector according to claim 1, wherein the diameter of the annular bearing surface of the central contact of the first connector element is smaller than the diameter of the annular bearing surface of the central contact of the second connector element.

5. A coaxial connector according to claim 1, wherein the diameter of the annular bearing surface of the outer contact of the first connector element is less than the diameter of the outer bearing surface of the outer contact of the second connector element.

6. A coaxial connector according to claim 1, wherein an electromagnetic shielding ring is disposed in said second volume around said inwardly-offset bearing surface of the outer contact of the second connector element.

* * * * *